US007360388B2

(12) United States Patent
Yamanaka et al.

(10) Patent No.: US 7,360,388 B2
(45) Date of Patent: Apr. 22, 2008

(54) HOLLOW STEPPED SHAFT AND METHOD OF FORMING THE SAME

(75) Inventors: Shigeaki Yamanaka, Hiroshima (JP); Takeshi Kazama, Hiroshima (JP); Masahiro Dohi, Hiroshima (JP)

(73) Assignee: Kubota Iron Works Co., Ltd., Hiroshima-shi (JP)

( * ) Notice: Subject to any disclaimer, the term of this patent is extended or adjusted under 35 U.S.C. 154(b) by 0 days.

(21) Appl. No.: 11/605,568

(22) Filed: Nov. 29, 2006

(65) Prior Publication Data

US 2007/0068215 A1 Mar. 29, 2007

Related U.S. Application Data

(62) Division of application No. 10/803,231, filed on Mar. 17, 2004, now Pat. No. 7,171,837.

(30) Foreign Application Priority Data

Jul. 24, 2003 (JP) ..... 2003-279168

(51) Int. Cl.
*B21J 13/00* (2006.01)
*B21D 28/00* (2006.01)

(52) U.S. Cl. ..... 72/355.6; 72/333

(58) Field of Classification Search ..... 72/353.2, 72/354.6, 355.2, 355.4, 355.6, 360, 356, 72/352, 358, 359, 267, 333, 325, 334
See application file for complete search history.

(56) References Cited

U.S. PATENT DOCUMENTS 2,593,730 A 4/1952 Cornell (Continued)

FOREIGN PATENT DOCUMENTS

| | | | |
|---|---|---|---|
| DE | 42 14 268 | C1 | 1/1994 |
| FR | 2 343 534 | A | 10/1977 |
| GB | 836 706 | A | 6/1960 |
| JP | 2001-334317 | A | 12/2001 |

OTHER PUBLICATIONS

Patent Abstracts of Japan, vol. 0120, No. 04 (M-657), Jan. 8, 1988 and JP 62-168626 A (Yamaha Motor Co. Ltd), Jul. 24, 1987—Abstract, Fig. 5.

(Continued)

*Primary Examiner*—Derris H. Banks
*Assistant Examiner*—Teresa M Bonk
(74) *Attorney, Agent, or Firm*—Frishauf, Holtz, Goodman & Chick, P.C.

(57) ABSTRACT

A hollow stepped article is formed from a solid blank to reduce the material cost, and cracking is prevented in a stepped portion of large diameter when a portion of the blank is deformed by its radial expansion. A hollow stepped shaft is formed by holding an upper and a lower part axially of a solid rod-like blank with an upper and a lower die, respectively, which have a stepped recess of large diameter in a region where they are opposed to each other; compressing the blank from both its axially opposite sides with an upper and a lower punch each of which is smaller in diameter than the blank, thereby extruding the blank so that an axial hollow is formed therein about its axis in each of its upper and lower parts and that a portion of the blank opposed to the stepped recess of large diameter expands in diameter and deforms into that recess while leaving a solid plug-like portion between the punches; and thereafter further compressively moving one of the punches to shear the solid plug-like portion and force it out of the blank, whereby the blank is formed with a stepped portion of large diameter by radially expanding deformation in a region intermediate between its opposed ends or at one of these ends and with a continuous axial hollow about its axis.

9 Claims, 15 Drawing Sheets

U.S. PATENT DOCUMENTS

| | | | | |
|---|---|---|---|---|
| 4,299,112 | A | 11/1981 | Kondo et al. | |
| 4,382,324 | A * | 5/1983 | Halene | 29/894.011 |
| 4,580,431 | A | 4/1986 | Oku et al. | |
| 4,653,310 | A | 3/1987 | Urata et al. | |
| 4,932,251 | A | 6/1990 | Okada et al. | |
| 5,088,311 | A * | 2/1992 | Inoue | 72/333 |
| 5,218,853 | A | 6/1993 | Mueller et al. | |
| 5,419,217 | A | 5/1995 | Umezawa et al. | |
| 7,013,696 | B2 * | 3/2006 | Ando et al. | 72/355.6 |

OTHER PUBLICATIONS

Patent Abstracts of Japan, vol. 1996, No. 12, Dec. 26, 1996 and JP 08-107184 A (Sekiguchi Sangyo KK), Aug. 6, 1996—Abstract.

Patent Abstracts of Japan, vol. 1997 No. 06 Jun. 30, 1997 and JP 09-047838 A (Mushashi Seimitsu Ind. Co. Ltd.), Feb. 18, 1997—Abstract, Figures.

Patent Abstracts of Japan, vol. 2002, No. 11, Nov. 6, 2002 and JP 2002-195244 A (Sonic Ishikawa Inc.), Jul. 10, 2002—Abstract.

* cited by examiner

HOLLOW STEPPED SHAFT AND METHOD OF FORMING THE SAME

This application is a Divisional of application Ser. No. 10/803,231, filed Mar. 17, 2004 now U.S. Pat. No. 7,171, 837.

BACKGROUND OF THE INVENTION

1. Field of the Invention

The present invention relates to a hollow stepped shaft which is formed in a region intermediate between its opposite ends or at one of its ends with a stepped portion larger in diameter than its axial portions and which is hollowed about its axis over its entire axial length or except for a portion thereof. The invention relates, inter alia, to a method of forming such a hollow stepped shaft and to a form or product made thereby.

2. Description of the Prior Art

A hollow shaft of this type has so far been formed by a method as described JP 2001-334317 A which uses a hollow tube as its starting blank material. The hollow tube is filled with a filler of a low melting point material and then loaded in an open die or a closed die in which the hollow tube together with the filler is compressed from both its axially opposite sides to cause its medial region to expand in diameter and to deform into an annular recess provided in the die.

The unit cost of a tubular material as the blank amounts in weight unit cost to three to five times higher than that of a solid material (rod stock), however. For this reason, the conventional method using a tubular material as its starting blank has the problem that the material cost is high.

Also, the axial compression of a blank that is already hollow to form a radial expansion as shown in FIG. 22A gives rise to the problem that a further axial compression of the radial expansion to increase its thickness causes a part of its inside to be bent and folded axially as shown in FIG. 22B and creates cracks in the grain flows which may become a critical internal defect.

BRIEF SUMMARY OF THE INVENTION

Made to solve the problems mentioned above, the present invention has for its object to provide a hollow stepped shaft and a method of forming it whereby material cost is made much lower than in the prior art and a critical internal defect due to cracking in a region of radial expansion can be prevented.

In order to achieve the object mentioned above, there is provided in accordance with the present invention in a first form of implementation thereof a method of forming a hollow stepped shaft, characterized in that it comprises the steps of: holding an upper and a lower part axially of a solid rod-like blank with an upper and a lower die, respectively, which have a stepped recess of large diameter in a region thereof where they are opposed to each other; compressing the blank from both its axially opposite sides with an upper and a lower punch each of which is smaller in diameter than the blank and at least one of which is moving, thereby extruding the blank so that an axial hollow is formed therein about its axis in each of the upper and lower parts and that a portion of the blank opposed to the stepped recess of large diameter expands in diameter and deforms into the recess while leaving a solid plug-like portion between the punches; and thereafter further compressively moving one of the punches to shear the solid plug-like portion and force it out of the blank, whereby the blank is formed with a stepped portion of large diameter by radially expanding deformation in a region intermediate between its opposed ends or at one of these ends and with a continuous axial hollow about its axis, thereby forming a hollow stepped shaft.

In the forming method mentioned above, the solid rod-like blank is loaded into the upper and lower dies which are in a closed die-fastened state and thereafter extrusion of the blank may be performed with the punches. Alternatively, the solid rod-like blank is loaded into the upper and lower dies which are in an open die-unfastened state and thereafter extrusion of the blank may be performed with the punches while the dies are being closed and fastened.

The method mentioned above may further comprise the step wherein a hollow stepped shaft so formed as aforesaid is further formed in another die set to impart an additional outer contour thereto. Also in the forming method mentioned above, in the further step the additional outer contour may be imparted to the hollow stepped shaft with a mandrel inserted therein.

The present invention also provides in a second form of implementation thereof a method of forming a hollow stepped shaft, characterized in that it comprises the steps of: supporting a solid rod-like blank at its first end with a bearer while its outer periphery is bound and extruding the blank about its axis from its second end with a first punch so as to form an axial hollow therein about the axis; and extruding the hollow blank forwards to backwards with a second and a third punch so as to form the hollow blank in a region thereof intermediate between the first and second ends or at one of these ends with a stepped portion enlarged in both diameter and thickness while simultaneously making the blank longer.

In the forming method mentioned above, the blank may be extruded about its axis with the first punch to form the axial hollow while the bearer supporting the blank at the first end is resiliently supported by a hydraulic or pneumatic means. Alternatively, the blank may be extruded about its axis to form the axial hollow by rapidly advancing the first punch while the bearer supporting the blank at its first end is allowed to move back slowly by a servo mechanism.

The present invention further provides in a third form of implementation thereof a method of forming a hollow stepped shaft, characterized in that it comprises the steps of: extruding a solid rod-like blank with its outer periphery bound, from its opposite sides about its axis with a first and a second punch so as to form a pair of axial hollows in its two axial parts, respectively, while leaving a solid plug-like portion of the blank between these two hollows; compressively moving one of the punches to shear the solid plug-like portion out of the blank whereby a single continuous axial hollow is formed from the axial hollows; and extruding the hollow blank forwards and backwards with a further punch so as to form the hollow blank in a region thereof intermediate between its opposite ends or at one of these ends with a stepped portion enlarged in both diameter and thickness while simultaneously making the blank longer.

In the forming method mentioned above, the solid plug-like portion may be sheared out of the blank by one of the first and second punches after the other punch is extracted and while the blank is supported resiliently at one of its ends by a hydraulic or pneumatic means. Alternatively, the solid plug-like portion may be sheared out of the blank by extracting one of the first and second punches and thereafter rapidly advancing the other punch while one end of the blank is moved back slowly by a servo mechanism.

In the forming method mentioned above, the solid rod-like blank may be made of carbon steel and may be hollowed at a rate of reduction in area of 25%. Then, the depth of the axial hollow in the blank may be set at a value that is 5 times or more larger than the inner diameter which is a criterion of stable working in a cold forging and its boring regions may be heated at a temperature ranging between a room temperature and 700° C.

In the forming method mentioned above, the hollow stepped shaft may have those regions in axial portions where serrations are formed having a tooth form applied thereto by fitting or press-and-shrink fitting, which may be further drawn or made smaller in diameter by multistage pressure forming with upper punches and lower dies.

According to the forming methods mentioned above in which a hollow stepped tube is formed from a solid blank such as a round rod as its starting material, the material cost can be sharply reduced compared with the conventional methods in which the starting material is a tubular blank. Further, since a solid blank is extruded with a punch or punches whereby an axial hollow is formed in the blank while a portion thereof in a medial area thereof is deformed so as to expand radially to form a stepped portion of large diameter, nothing is the case here that grain lines in the part deformed and enlarged in diameter may be axially folded and buckled as in the prior art. Thus, rather than broken in such a stepped portion as in the prior art, here the grain flows are streamlined and there can develop no defect such as cracking.

The present invention also provides a hollow stepped shaft made by any one of the preceding methods.

Since this hollow stepped tube has the hollow which except for the stepped portion of large diameter is shaped to conform in diameter to the outer contour and in other words having the axial portions uniformly thinned over their lengths, it is much lighter in weight than those made by cutting as in the prior art, namely in which the hollow is even in diameter and which thus must have been large in thickness.

BRIEF DESCRIPTION OF THE DRAWINGS

These and other objects, features and advantages of the present invention as well as other manners of its implementation will become more readily apparent, and the invention itself will also be better understood, from the following detailed description when taken with reference to the drawings attached hereto showing certain illustrative forms of implementation of the present invention. In the drawings.

DETAILED DESCRIPTION

Figure 3:
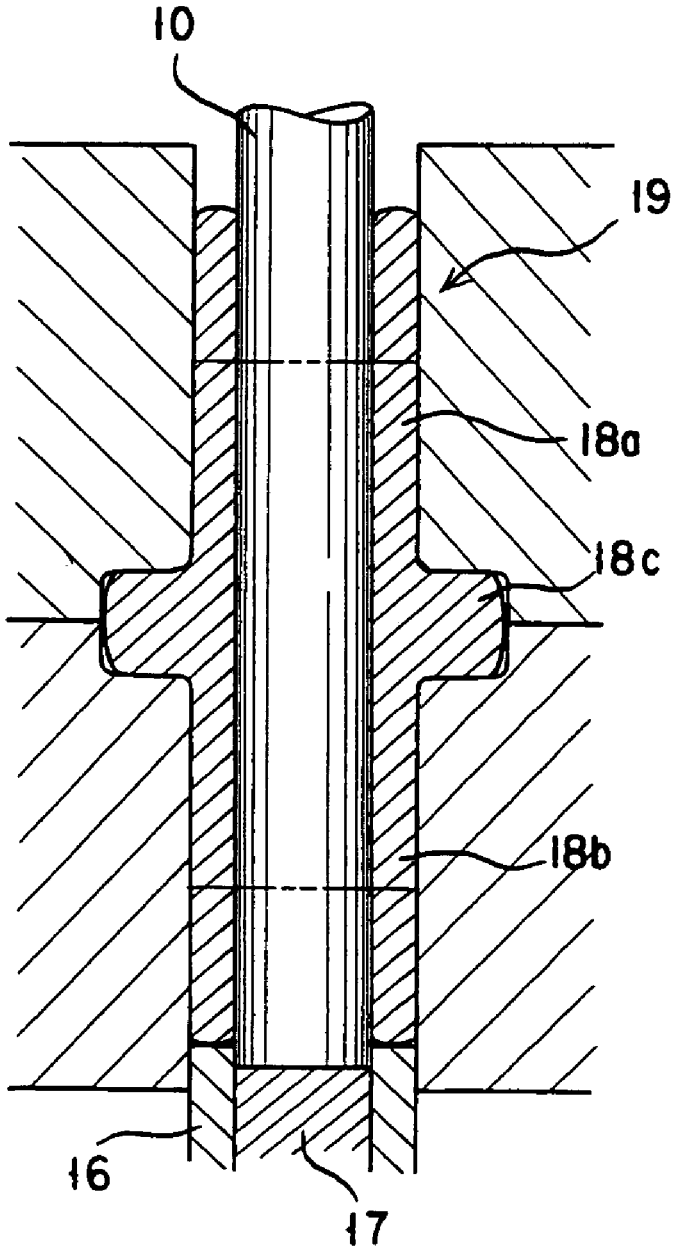
FIG. 3 is a cross sectional view illustrating a third step in the first process in the first embodiment of the present invention.
Figure 4:
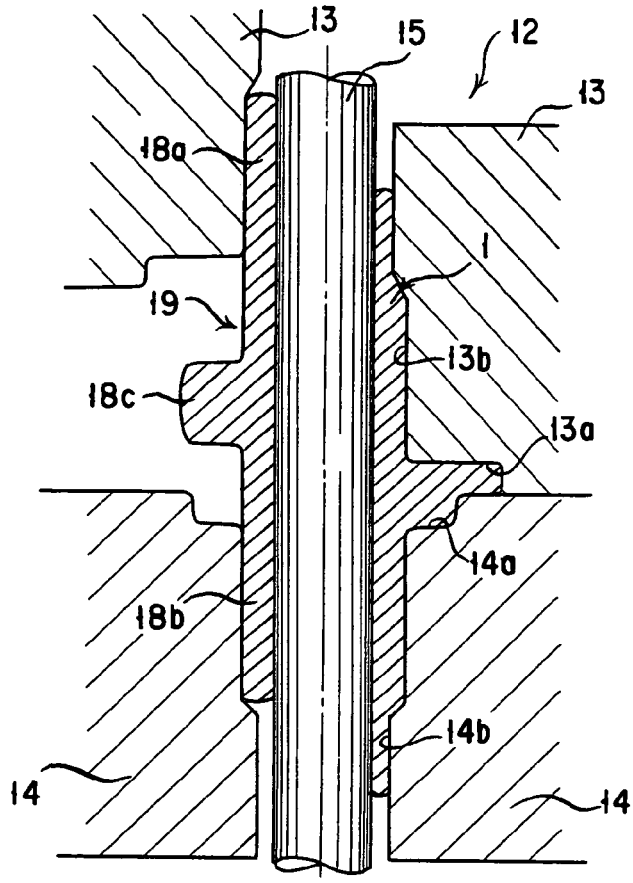
FIG. 4 is a cross sectional view illustrating a second process in the first embodiment of the present invention.
Figure 5:
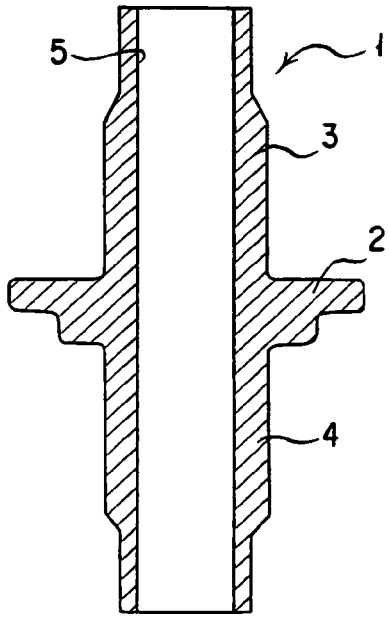
FIG. 5 is a cross sectional view illustrating a hollow stepped shaft formed by the first embodiment of the present invention.

Referring to FIGS. 1 to 7, an explanation is given in respect to a first embodiment of the method of the present invention. Here, a solid rod-like member is extruded to make it hollow and at the same time to deform and expand an axially medial region of it radially to form it there with a stepped portion of large diameter. FIG. 5 shows an exemplary hollow stepped shaft 1 to be formed by the first embodiment of the present method. The hollow stepped shaft 1 comprises a stepped portion of large diameter 2 formed in an axially medial region of the shaft and larger in diameter than elsewhere thereof, and axial portions 3 and 4 at two opposite sides of the stepped portion of large diameter 2. Further, the hollow stepped shaft 1 is made hollow by being formed about its axis with a bore or hollow 5.

Figure 1:
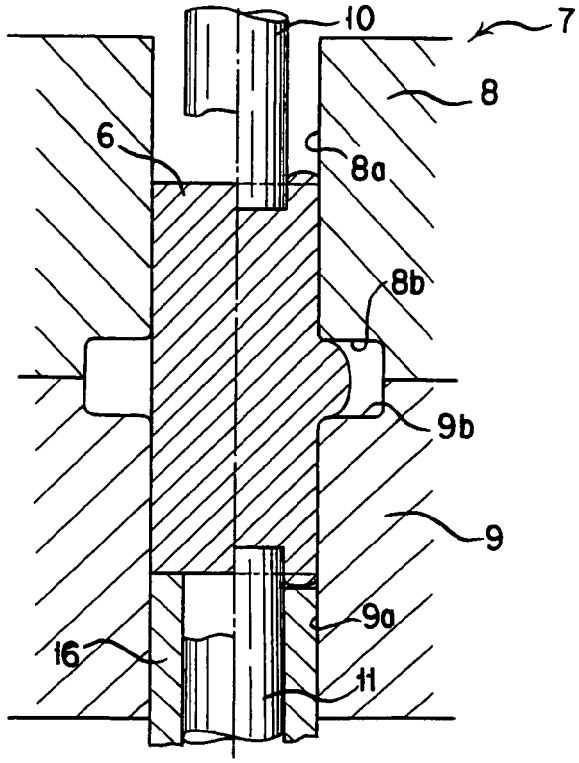
FIG. 1 is a cross sectional view illustrating a first step in a first process in a first embodiment of the present invention.
Figure 2:
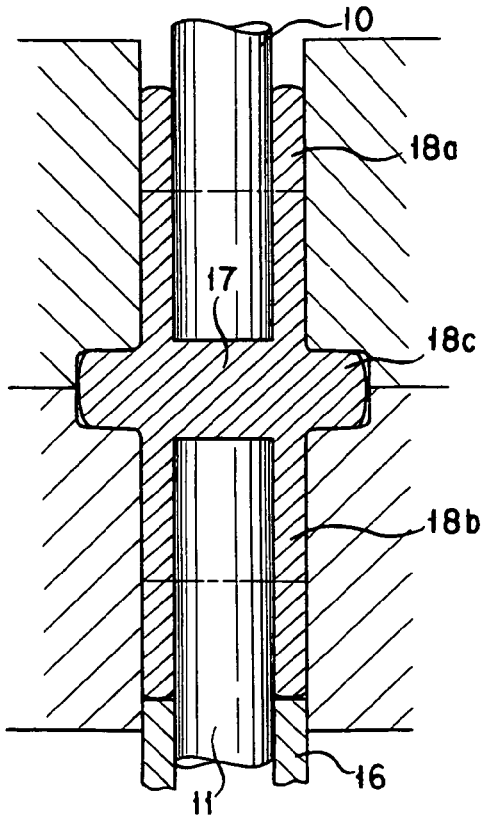
FIG. 2 is a cross sectional view illustrating a second step in the first process in the first embodiment of the present invention.

FIGS. 1 to 3 show a first, a second and a third step, respectively, in a first process for forming the hollow stepped shaft 1. A blank made of a solid round bar or rod is indicated at 6. A first die set 7 comprises an upper and a lower die 8 and 9 formed with coaxial bores 8*a* and 9*a* for receiving the blank 6 and also formed with stepped bore or recesses of large diameter 8*b* and 9*b* where they are opposed to and here also contact with each other, the stepped bores of large diameter 8*b* and 9*b* being larger in diameter than the bores 8*a* and 9*a*. An upper and a lower punch 10 and 11 are smaller in diameter than the blank 6 and inserted into the bores 8*a* and 9*a* of the upper and lower dies 8 and 9, respectively. Indicated at 16 is a knockout in the form of a cylindrical sleeve inserted into the bore 9*a* of the lower die 9 while encircling the punch 11 therewith.

FIG. 4 shows a second process in this embodiment of the present method. A second die set 12 includes an upper and a lower die 13 and 14 and a mandrel 15. The upper and lower dies 13 and 14 have stepped forming recesses of large diameter 13*a* and 14*a* across their split face set to correspond in position to a center of the stepped portion of large diameter 2 of the hollow stepped shaft 1 for jointly forming this stepped portion of large diameter, and axial portion forming bores 13*b* and 14*b* for forming the axial portions 3 and 4, respectively. Here, the axial portion forming bore 14*b* of the lower die 14 is adapted to received and hold, one of two axial portions of an intermediate form or product formed by the first process.

Mention is next made of the forming method using the first and second die sets 7 and 12 with reference to FIGS. 1 to 4.

In the first step shown in FIG. 1 in the first process shown in FIGS. 1 to 3, the blank 6 is loaded into and set in the bores 8*a* and 9*a* of the first die set 7 as it is clamped. Then, supported by either the knockout 16 alone or both the punch 11 and knockout 16, the blank 6 is positioned vertically. The vertical (axial) position of the blank 6 is set in accordance with where in its medial region the stepped portion of large diameter 2 of the hollow stepped shaft 1 (as a product) is to be positioned (see the left hand side in FIG. 1).

Next, in the second step shown in FIG. 2, the upper and lower punches 10 and 11 are moved towards to each other to extrude the blank 6 from its both sides axially. This by backward extrusion forces both upper and lower parts of material of the blank 6 to flow into cylindrical open spaces in the upper and lower dies 8 and 9 while by forward extrusion forces a medial part of it is forced and deformed into the stepped expansion forming recesses 8*b* and 9*b*. Then, the knockout 16 which has supported the blank 6 is moved down with its lower backward extrusion.

In the second step shown in FIG. 2, the extrusion with the punches 10 and 11 terminates when their ends reach positions where they are opposed across the stepped forming recesses of large diameter 8*b* and 9*b*, respectively, whereby a pair of cylinder portions 18*a* (upper) and 18*b* (lower) are formed in axially opposite sides across a solid plug-like portion 17 positioned in an axially medial region of the blank 6 between the two punches 10 and 11. And, the blank 6 is simultaneously formed in its medial region with a stepped portion of large diameter 18*c* deformed into the stepped recesses 8*b* and 9*b*. Then, the stepped portion of large diameter 18*c* having been expanded and deformed stepwise from a solid state, there the lines of grain flow are continuous with no buckling created.

Then, in a third step as shown in FIG. 3, by way of example the lower punch 11 is extracted and the upper punch 10 is moved down further whereby the solid plug-like portion 17 is sheared in the axial direction and forced out as an extract refuse piece. This completes the first process whereby an intermediate form or product 19 that is hollow and stepped is produced, in which grain flows in the stepped zone are streamlined in the absence of any break.

The intermediate form or product 19 is finish-formed in the second process shown in FIG. 4. The intermediate form 19 is loaded into and set in the second die set 12 so that its lower cylinder portion 18*b* is received in the axial portion forming bore 14*b* (hung on its large-diameter rim) of the lower die 14. In this embodiment, it is also seen that the mandrel 15 is inserted into the hollow (axial bore) of the intermediate form 19.

After that, the upper die 13 is moved down whereby the intermediate form 19 with its hollow held by the mandrel 15 has its axial portions 18*a* and 18*b* squeezed through the respective small-diameter rims of the axial portion forming bores 13*b* and 14*b*, and the respective squeezed volumes of the axial portions 18*a* and 18*b* are forced out axially. Also the stepped portion of large diameter 18*c* is axially compressed by the stepped forming recesses of large diameter 13*a* and 14*a* of the upper and lower dies 13 and 14 to expand and deform into them and the stepped portion is thereby formed into a shape complementary to a shape defined by the inner contours of the recesses of large diameter 13*a* and 14*a*. As a result, there is formed a hollow stepped shaft 1 as shown in FIG. 5 that is finished having an inner diameter sized to the mandrel 15 and an outer contour shaped to correspond to an inner contour of the second die set 12 as shown in FIG. 4.

Figure 6:
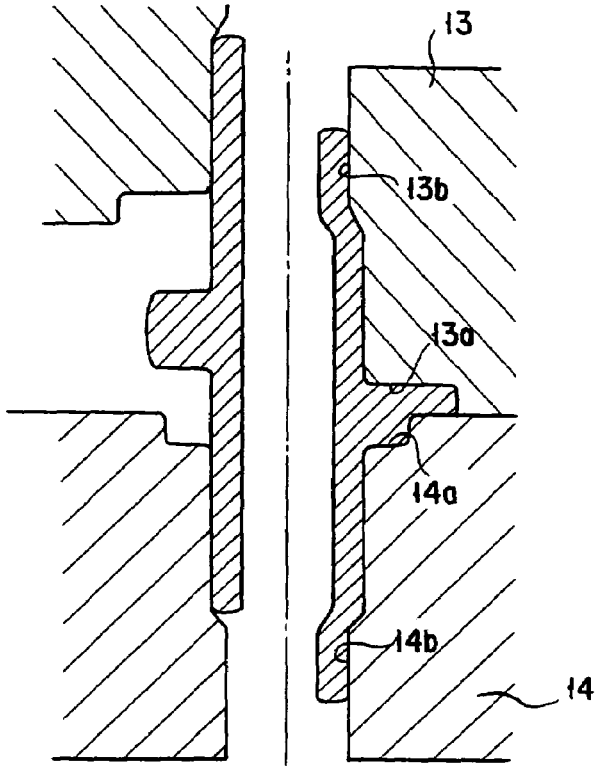
FIG. 6 is a cross sectional view illustrating an alternative second process in the first embodiment of the present invention.
Figure 7:
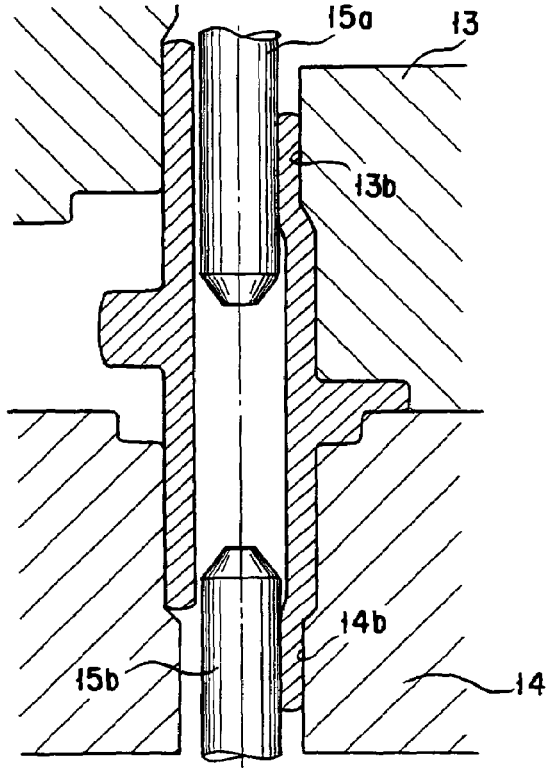
FIG. 7 is a cross sectional view illustrating another alternative second process in the first embodiment of the present invention.

FIG. 6 shows a case in which the mandrel 15 is not inserted in the second process. In this case, portions of the blank formed by the small-diameter rims of the axial portion forming bores 13*b* and 14*b* of the upper and lower dies 13 and 14 are deformed inwards, reducing the diameter of the axial hollow there of the intermediate form 19. If it is desired to set these axial portions reduced in inner diameter at a selected size, mandrels 15*a* and 15*b* so dimensioned are partially inserted as shown in FIG. 7.

An explanation is given in respect of a second embodiment of the present method with reference to FIGS. 8 to 11. This embodiment is so designed that a hollow stepped shaft 20 of a selected shape as shown in FIG. 12 is formed in the first process in the first-mentioned embodiment. This hollow stepped shaft 20 like that formed in the first embodiment is formed with a stepped portion of large diameter 21, axial portions 22 and 23 at axially both sides of the stepped portion of large diameter 21, and an axial hollow or axially penetrating bore 24.

In the Figures, there are shown a die set 25 and a blank 26 made of a solid round rod. The die set 25 comprises an upper and a lower die 27 and 28 with their split face corresponding in position to the stepped portion of large diameter 21 of the hollow stepped shaft 20. The upper die 27 is formed with a bore 27*a* through which the blank 26 is received, and a stepped forming recess of large diameter 27*b* that is larger in diameter than the blank 26 while the lower die 28 is formed with a bore 28*a* through which the blank 26 is received. An upper and a lower punch 29 and 30 are shown inserted into and received through the bores 27*a* and 28*a* of the upper and lower dies 27 and 28, respectively, and have extruder punches 29*a* and 30*b* smaller in diameter mounted coaxially therewith, respectively, for extruding the blank 26.

Mention is next made of a forming method in this second embodiment with reference to FIGS. 8 to 11.

Figure 8:
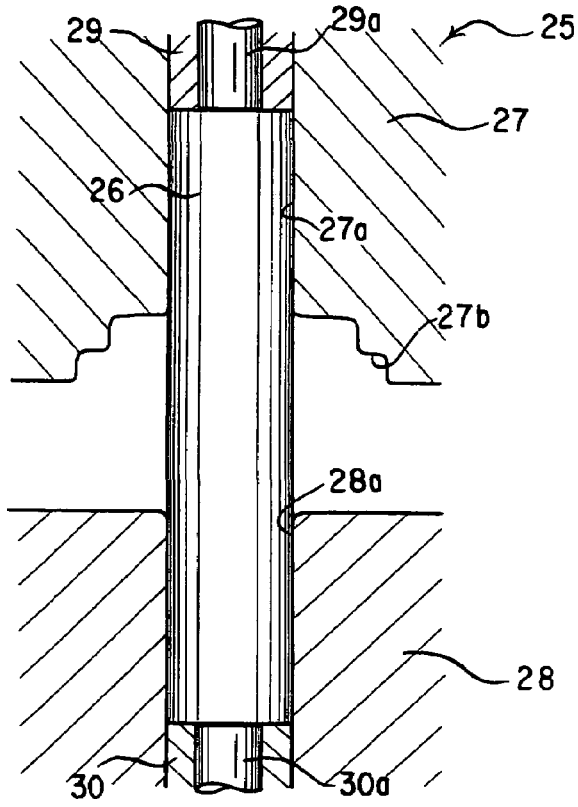
FIG. 8 is a cross sectional view illustrating a first step in a second embodiment of the present invention.

In the first step shown in FIG. 8, the blank 26 is inserted into the bore 28*a* of the lower die 28 in an open state. The blank 26 is then supported by the lower punch 30 and its extruder punch 30*a* to lie at a vertical position set to correspond to that of the stepped portion of large diameter 21 of the hollow stepped shaft 20 to be formed as a product from the blank 26 in the stepped forming recess of large diameter 27*b*. After that, with the upper die 27 spaced away from the lower die 28 by a selected distance, its bore 27*a* is allowed to accept the blank 26, and the upper punch 29 and its extruder punch 29*a* are brought into contact with the upper end of the blank 26.

Figure 9:
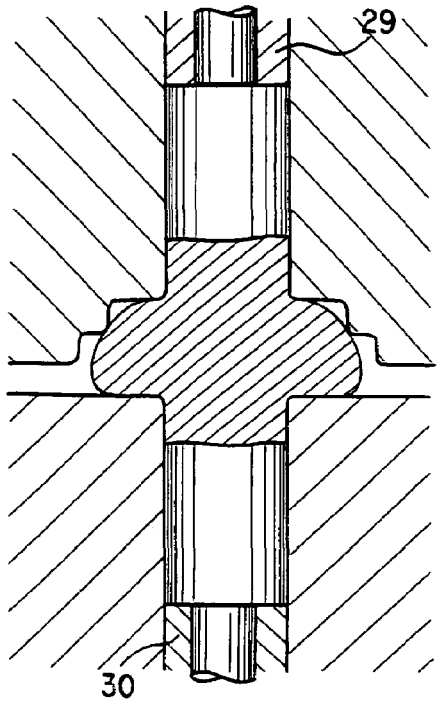
FIG. 9 is a cross sectional view illustrating a second step in the second embodiment of the present invention.

This state shown in FIG. 8 is followed by the second step shown in FIG. 9 in which the upper die 27, punch 29 and extruder punch 29*a* are moved down in a body. This causes a portion of the blank 26 in the upper die 27 to be forced down and a portion of the blank 26 intermediate between the punches 29, 29*a* and 30, 30*a* to be forced radially outwards and deformed into a space defined by the stepped forming recess of large diameter 27*b* of the upper die 27 and the lower die 28. Then, the amount of expansion is set appropriately to be somewhat smaller than the size of the stepped portion in the formed product 20.

Figure 10:
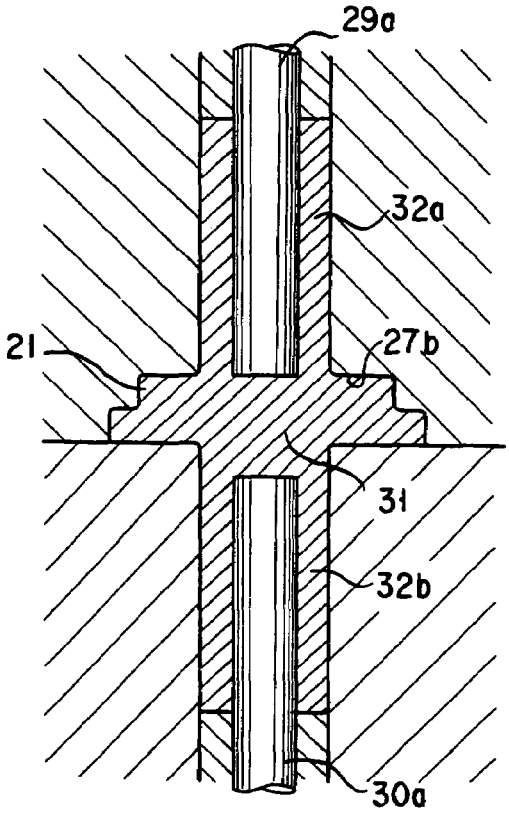
FIG. 10 is a cross sectional view illustrating a third step in the second embodiment of the present invention.

The state shown in FIG. 9 is followed by the third step shown in FIG. 10 in which the downward movement of the upper die 27 is continued to effect die clamping. During this further downward movement of the upper die 27 or after the die clamping is effected, the upper and lower punches 29 and 30 are freed whereupon the extruder punches 29*a* and 30*a* are moved towards each other to force to form the blank 26 from its both sides axially. This causes the upper and lower parts of the blank 26 to be each extrude backwards into cylindrical open spaces of the bores 27*a* and 28*a* of the upper and lower dies 27 and 28, respectively, while the axially medial part is extruded forwards to expand and deform into the stepped forming recess of large diameter 27*b*.

As shown in FIG. 10, this extrusion forming step by the extruder punches 29*a* and 30*a* terminates when their ends reach positions where they are opposed across the stepped expansion forming recess 27*b* or any appropriate positions whereby a pair of cylinder portions 32*a* and 32*b* are formed across a solid plug-like portion 31 at its axially opposite sides, the portion 31 lying between the opposed ends of the punches 29*a* and 30*a* in an axially medial region of the blank 26, and at the same time in this medial region there is formed into the stepped forming recess of large diameter 27*b* the stepped portion of large diameter 21 as a continuous extension of the solid plug-like portion 31. Hence, the stepped portion of large diameter 21 here is a continuous, radially expanded deformation deformed from a solid state along consecutive lines of grain flow while undergoing no buckling.

Figure 11:
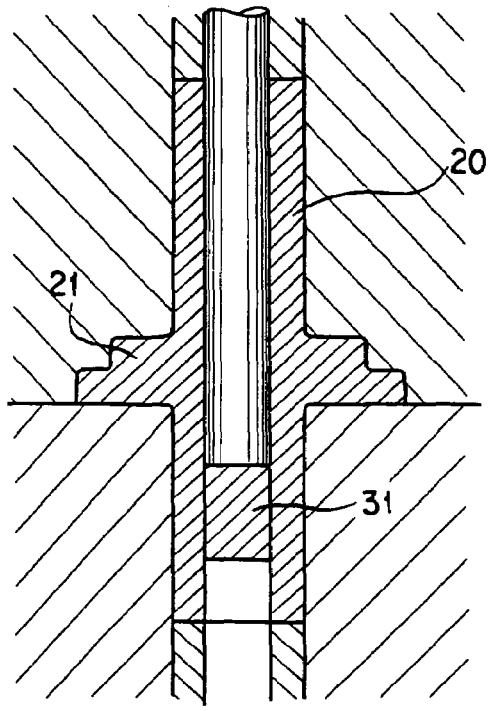
FIG. 11 is a cross sectional view illustrating a fourth step in the second embodiment of the present invention.
Figure 12:
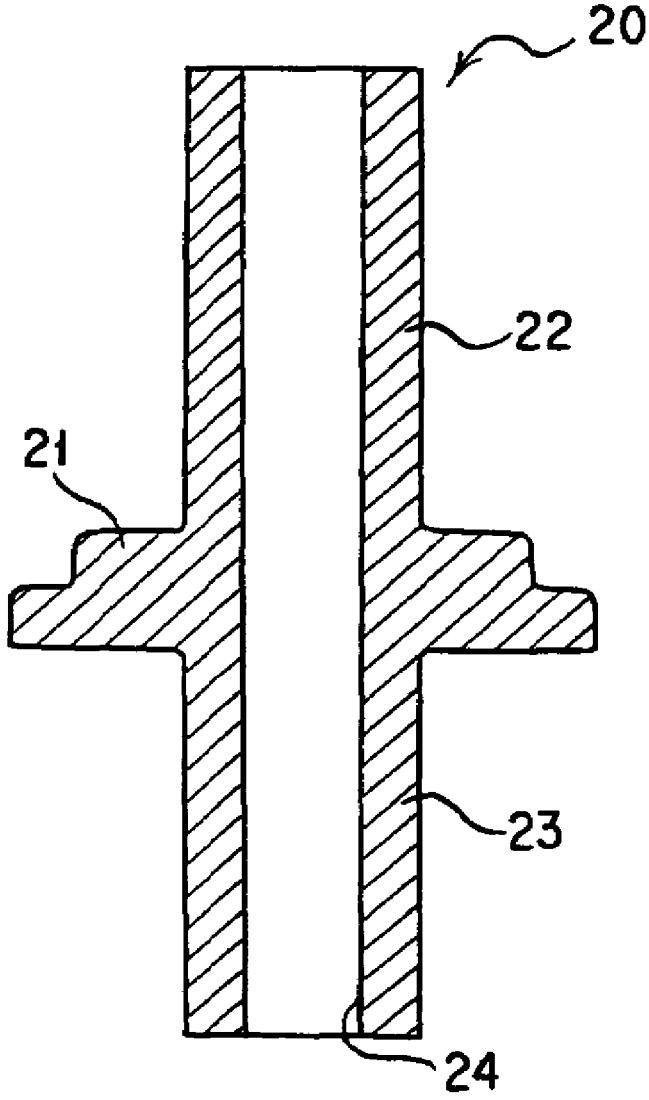
FIG. 12 is a cross sectional view illustrating a hollow stepped shaft formed by the second embodiment of the present invention.

Subsequently, in a fourth step as shown in FIG. 11, by way of example the lower extruder punch 30*a* is extracted and the upper extruder punch 29*a* is further moved down to continue to extrude. This causes the abovementioned solid plug-like portion 31 to be sheared axially and forced out and removed from the blank 26 as an extract refuse piece, thereby giving rise to a hollow stepped shaft 20 as shown in FIG. 12.

Although in this second embodiment the blank 26 is shown as loaded in the upper die 27 open and this upper die 27 is shown as moved down together with the punch 29 and extruder punch 29*a*, the blank 26 may be loaded in the upper die 27 closed, and then the upper punch 29 and extruder punch 29*a* may be moved down while the lower punch 30 and extruder punch 30*a* are moved up.

Figure 15:
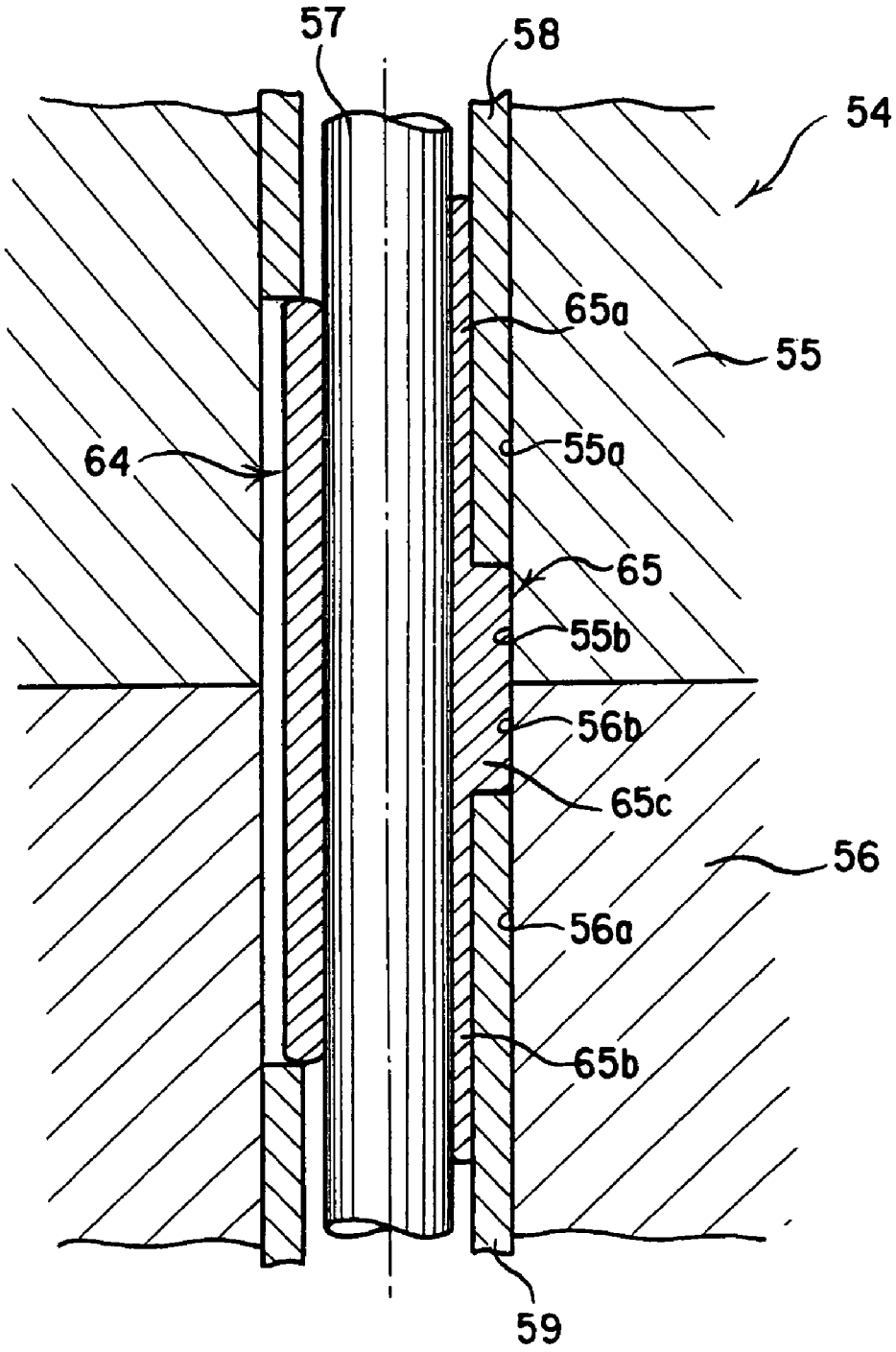
FIG. 15 is a cross sectional view illustrating a second process in the third embodiment of the present invention.
Figure 16:
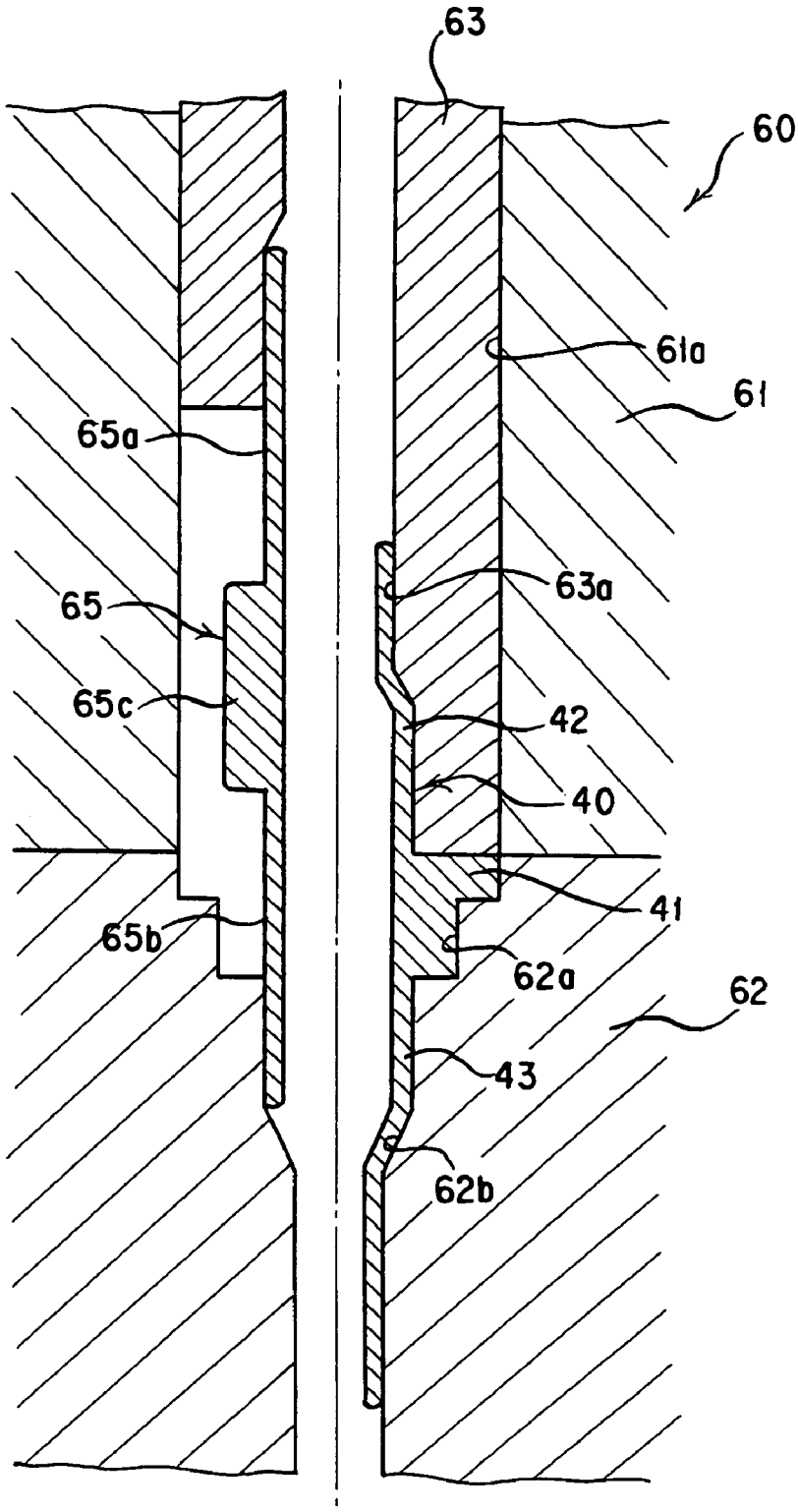
FIG. 16 is a cross sectional view illustrating a third process in the third embodiment of the present invention.
Figure 17:
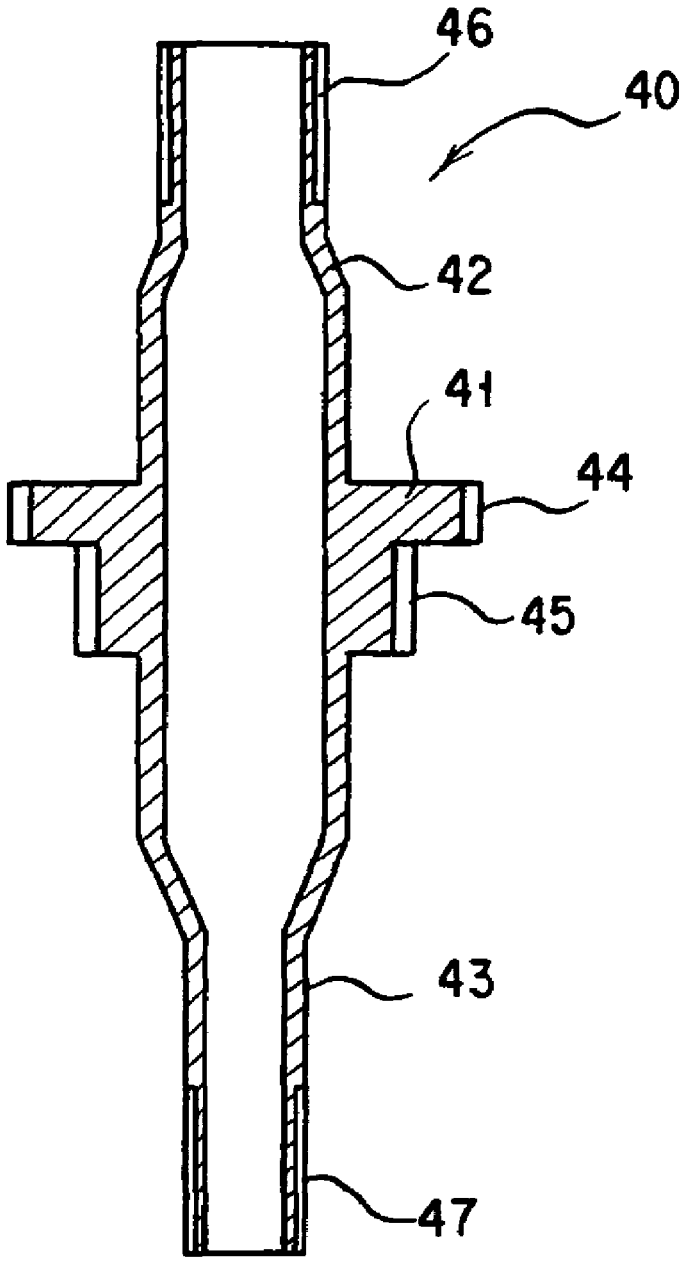
FIG. 17 is a cross sectional view illustrating a hollow stepped shaft formed by the third embodiment of the present invention.

An explanation is next given in respect of a third embodiment of the present method with reference to FIGS. 13 to 17. In this embodiment, a solid rod-like blank as it is shorter than a form or formed product to be formed is made both hollow and longer in a first process extrusion and the hollowed blank is then subjected to a second process of forward and backward extrusion designed to make its length still longer and the thickness in its upper and lower parts thinner while causing a medial region between them to radially expand stepwise, forming there a stepped portion enlarged in both outer diameter and thickness. The form eventually formed in this embodiment is a hollow stepped shaft 40, as shown in FIG. 17, having a stepped portion of large diameter 41 and a pair of axial portions 42 and 43 lying at its axially opposite sides. The stepped portion of large diameter 41 is formed to be larger in thickness and formed on its outer periphery with teeth 44 and 45, and the axial portions 42 and 43 are made to be thinner and smaller in diameter and are formed with serrations 46 and 47 which are each designed to have a tooth form (not shown) applied thereto by simple fitting or press-and-shrink fitting.

Figure 13:
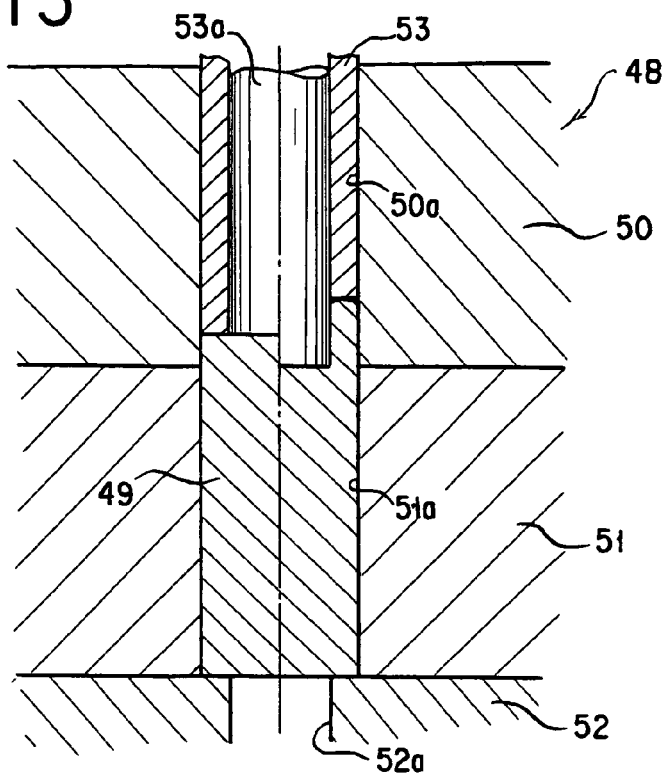
FIG. 13 is a cross sectional view illustrating a first step in a first process in a third embodiment of the present invention.
Figure 14:
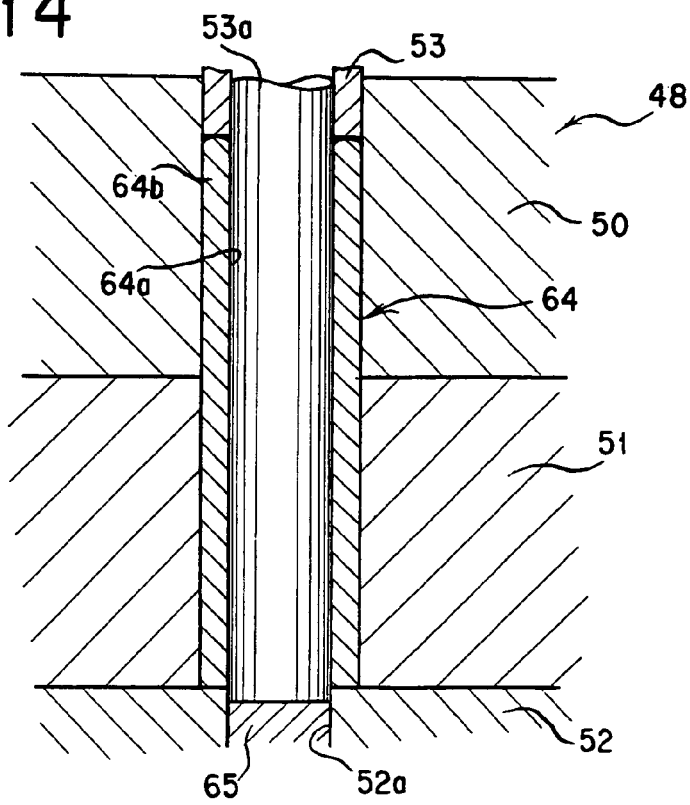
FIG. 14 is a cross sectional view illustrating a second step in the first process in the third embodiment of the present invention.

FIGS. 13 and 14 show a first and a second step in the first process for forming the hollow stepped shaft 40. In the Figures there are shown a first die set 48 and a blank 49 made of a solid round rod. The first die set 48 comprises an upper and a lower die 50 and 51, and a bearer or pedestal 52 supporting them. The upper and lower dies 50 and 51 are formed with bores 50*a* and 51*a* in which the blank 49 is accepted. A punch 53 to be inserted into the bores 50*a* and 51*a* has an extruder punch 53*a* mounted therein coaxially therewith and that is smaller in diameter than the blank 49. The bearer 5.2 is elastically or resiliently supported by a hydraulic or pneumatic unit (not shown) and is formed with a hole 52*a* into which the lower end of the extruder punch 53*a* can be accepted.

FIG. 15 shows the second process in this embodiment. In the Figure, there are shown a second die set 54 which comprises an upper and a lower die 55 and 56, a mandrel 57, and an upper and a lower punch 58 and 59 which are each in the form of a cylindrical sleeve. The upper and lower dies 55 and 56 are formed with coaxial bores 55*a* and 56*a* into which a first intermediate form formed in the first process is accepted and into which the upper and lower punches 58 and 59 opposed each other are also to be inserted. The mandrel 57 has an outer diameter that is equal to that of an axial hollow of the first intermediate form, and each of the upper and lower punches 58 and 59 has an inner diameter that is smaller than the outer diameter of the first intermediate form.

FIG. 16 shows a third process. In the Figure, there are shown a third die set 60 which comprises an upper and a lower die 61 and 62, and an upper punch 63 which is in the form of a nearly cylindrical sleeve. The upper and lower dies 61 and 62 has their split face positioned at one end face of the stepped portion of large diameter 41 in the hollow stepped shaft 40 shown in FIG. 17, and the upper die 61 is formed with a bore 61*a* into which the upper punch 63 is to be inserted while the lower die 62 is formed with a stepped forming recess of large diameters 62*a* in which the stepped portion of large diameter 41 of the hollow stepped shaft 40 is to be formed and an axial portion forming bore 62*b* in which one axial portion 43 thereof is to be formed. The upper punch 63 is formed in a lower end of its axial bore with an axial portion forming bore 63*a* in which the other axial portion 42 of the hollow stepped shaft 40 is to be formed. Here, the axial portion forming bore 62*b* in the lower die 62 is so shaped that it can bear and support one (lower) axial portion of a second intermediate form formed in the second process.

Mention is next made of the forming method in the third embodiment with reference to FIGS. 13 to 16.

In the first step shown in FIG. 13, the blank 49 is inserted into the bore 61*a* in the lower die 51 in the open state to have its lower end supported by the bearer 52. After that, the upper die 50 is moved down to close the die set 48. Then, the punch 53 and extruder punch 53*a* are brought into contact with the upper end of the blank 49. At this time, the punch 53 is set free.

This state is followed by the second step shown in FIG. 14 in which moving the extruder punch 53*a* down forms an axial hollow 64*a* in the blank 49 about its axis and the same time forms from the blank 49 a hollow cylinder 64*b* that grows upwards by backward extrusion while leaving a solid plug-like portion which is finally axially sheared and forced out as an extract refuse piece 65. A first intermediate form 64 that is hollow is thus formed.

In the first process mentioned above, typically the solid rod-like blank 49 is made of carbon steel and is hollowed at a rate of reduction in area of 25%. The depth of the axial bore is set at a value that is 5 times or more larger than the inner diameter which is a criterion of stable working in a cold forging. To hollow the blank, its boring region is heated at a temperature ranging between a room temperature and 700° C. and its outer periphery is bound. While in this example the bearer 52 is mounted below the lower die 51 and the extruder punch 53*a* is moved down to hollow the blank 49 about its axis, it is also possible to mount a bearer 52 above the upper die 50 and use an extruder punch 53*a* that can be moved up to hollow the blank 49 about its axis. Alternatively, the bearer 52 may be controllably coupled to a servo mechanism so that the bearer 52 may recede or moved down slowly thereby while the extruder punch 53*a* is rapidly advanced to form a hollow in the blank about its axis.

The first intermediate form 64 is further formed in the second process shown in FIG. 15. It is loaded in the bores 55*a* and 56*a* of the second die set 54 in the closed and fastened state. Then, the first intermediate form 64 is supported between the upper and lower punches 58 and 59 and vertically positioned. Further, the mandrel 57 is inserted into the axial hollow of the first intermediate form 64

Subsequently, the upper and lower punches 58 and 59 are moved towards each other to form the first intermediate form 64 axially by forward and backward extrusion. This causes each of an upper and a lower part of the first intermediate form 64 to be extruded into each of open cylindrical spaces (defined between the upper punch 58 and the mandrel 57 and between the lower punch 59 and the mandrel 57) in the upper and lower dies 55 and 56, respectively, and at the same time a medial portion of the form 64 to be radially expanded and deformed into a recess (defined among the lower end face of the upper punch 58, the upper die 55, the lower die 56 and the upper end face of the lower punch 59). This process of extrusion forming by both the punches 58 and 59 terminates when they reach positions where they are opposed to each other across a predetermined spacing whereby a second intermediate form 65 is formed having a pair of cylindrical portions 65*a* and 65*b* formed at its axially opposite sides and a stepped portion of radial expansion 65*c* formed at a medial region thereof. Here, the stepped portion of radial expansion 65*c* having been deformed by stepped portion of large diameter is a deformation in which the grain flow is continuous and having no buckling.

The second intermediate form 65 is finish-formed in a third process as shown in FIG. 16. It is loaded into and set in the third die set 60 so that the lower cylindrical portion 65*b* of the second intermediate form 65 is supported by the axial portion forming bore 62*b* and accepted in its large-diameter bore part of the lower die 62 in the third die set 60.

After that, the upper punch 63 is moved down. This causes the axial portions 65*a* and 65*b* of the second intermediate form 65 to be draw-formed and deformed inwards while reducing their diameter by the small-diameter part of the axial portion forming bore 63*a* in the upper punch 63 and the small-diameter part of the axial portion forming bore 62*b* of the lower die 62. And, the stepped portion of radial expansion 65*c* is extruded axially and expanded radially by the lower end of the upper punch 63 and the stepped forming recess of large diameters 62*a* of the lower die 62 to conform to the inner contour of the latter. Further, those regions in the axial portions 65*a* and 65*b* where the serrations are formed having the tooth form (not shown) applied thereto by fitting or press-and-shrink fitting may be further drawn or made smaller in diameter by multistage pressure forming with upper punches and lower dies.

A hollow stepped shaft 40 is thus formed having a stepped portion of large diameter 41 and a pair of axial portions 42 and 43 located at its opposite sides. Since this hollow stepped tube 40 has the hollow which except for the stepped portion of large diameter 41 is shaped to conform in diameter to the outer contour and in other words having the axial portions 42 and 43 uniformly thinned over their lengths, it is much lighter in weight than those made by cutting as in the prior art, namely in which the hollow (axial bore) is even in diameter and which thus must have been large in thickness. Further, the stepped portion of large diameter 41 and the axial portions 42 and 43 may later be formed with teeth 44 and 45 and serrations 46 and 47 as shown in FIG. 17, by cutting or the like.

Figure 18:
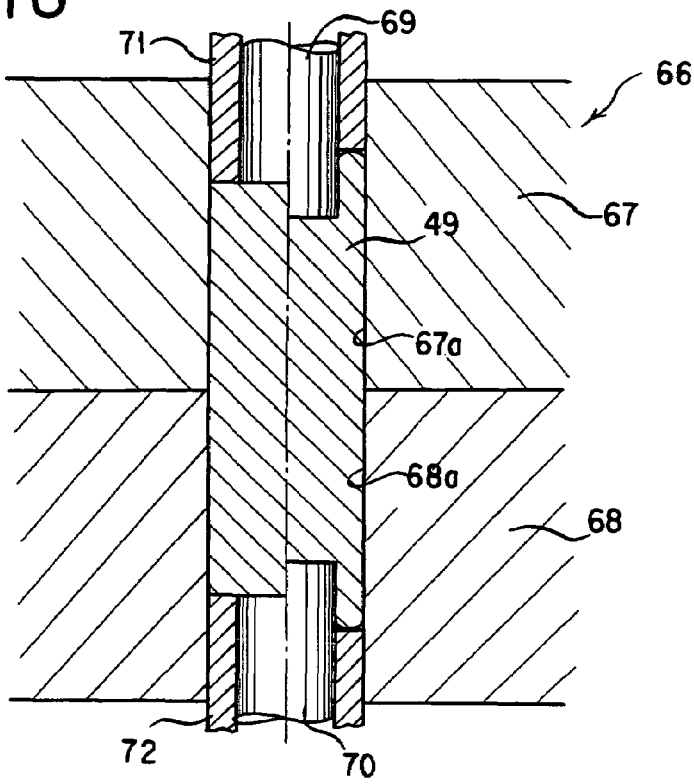
FIG. 18 is a cross sectional view illustrating a first step in a first process in a fourth embodiment of the present invention.
Figure 19:
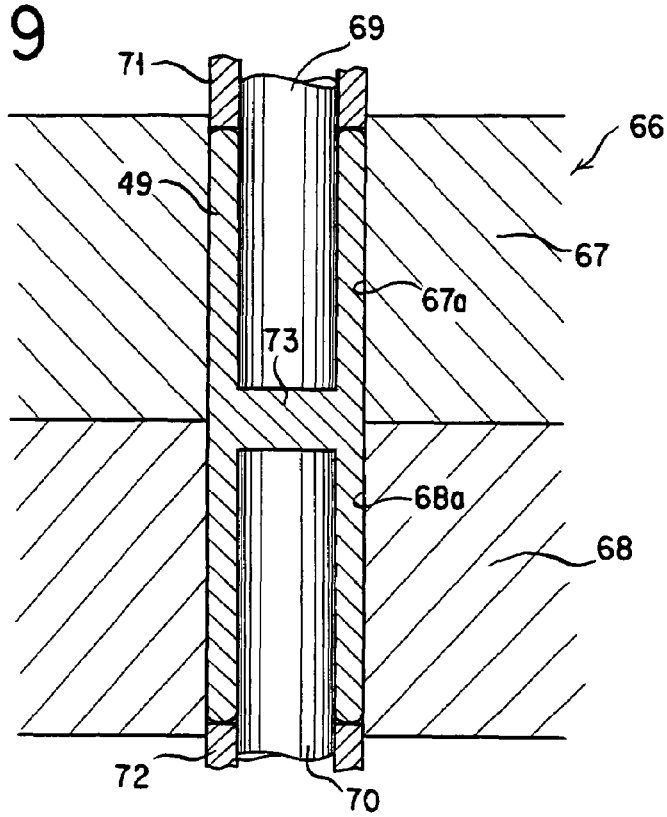
FIG. 19 is a cross sectional view illustrating a second step in the first process in the fourth embodiment of the present invention.
Figure 20:
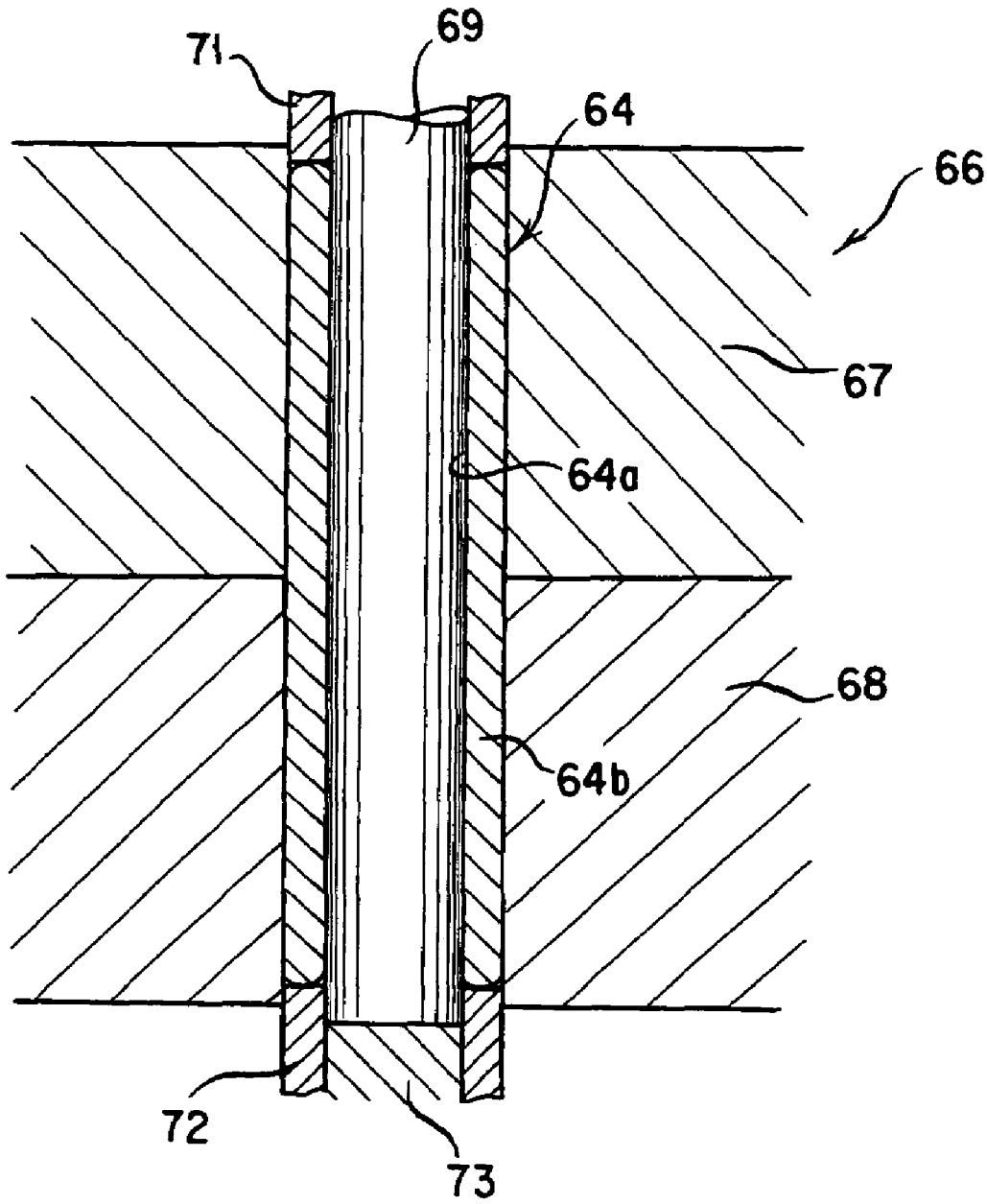
FIG. 20 is a cross sectional view illustrating a third step in the first process in the fourth embodiment of the present invention.

An explanation is next given in respect of a fourth embodiment of the present method with reference to FIGS. 18 to 20. The embodiment differs from the third embodiment in the first process in which a solid rod-like blank is hollowed as it is shorter than its form, but is identical to the third embodiment in the second and third processes of extruding the hollowed blank forwards to backwards so as to form the hollow blank with a stepped portion enlarged in both diameter and thickness while simultaneously making the blank longer, thereby forming a hollow stepped shaft 40 as shown in FIG. 17.

FIGS. 18, 19 and 20 show a first, a second and a third step in the first process for forming a hollow stepped shaft from a solid rod-like blank 49. In the Figures, there are shown a first die set 66 which comprises an upper and a lower die 67 and 68, and an upper and a lower punch 69 and 70. The upper and lower dies 67 and 68 are formed with bores 67*a* and 68*a* coaxial with each other, respectively, into which the blank 49 is accepted. The upper and lower punches 69 and 70 are smaller in diameter than the blank 49 to enter the bores 67*a* and 68*a* in the upper and lower dies 67 and 68, respectively. Also shown are an outer punch 71 in the form of a cylindrical sleeve inserted into the bore 67*a* and encircling the upper punch 69 and a knockout 72 in the form of a cylindrical sleeve inserted into the bore 68*a* and encircling the lower punch 70. The knockout 72 is resiliently supported by an oil hydraulic or pneumatic means.

Mention is next made of the forming method according to the fourth embodiment with reference to FIGS. 18 to 20.

In the first step shown in FIG. 18 of the first process shown in FIGS. 18 through 20, the blank 49 is loaded into and set in the bores 67*a* and 68*a* of the first die set 66 in its closed and fastened state. The blank 49 is then supported by either the knockout 72 alone or both the lower punch 70 and the knockout 72.

Next, in the second step shown in FIG. 19, the upper and lower punches 69 and 70 are moved towards each other to extrude the blank 49 from both its opposite sides axially. This by backward extrusion forces both upper and lower parts of material of the blank 49 to flow into cylindrical open spaces in the upper and lower dies 67 and 68. In this course, the outer punch 71 is allowed to move up following the backward extrusion of the upper part of the blank 49 by the upper punch 69 and the knockout 72 to move down following the backward extrusion of the lower part of the blank 49 by the lower punch 70.

In the second step shown in FIG. 19, the extrusion with the punches 69 and 70 terminates when their ends reach positions where they are opposed to each other across a small spacing, leaving a solid plug-like portion 73 of the blank between the punches 69 and 79 in an axially medial region of the blank 49.

Then, in a third step as shown in FIG. 20, by way of example the lower punch 70 is extracted and the upper punch 69 is moved down further whereby the plug-like portion 73 is sheared in the axial direction and forced out as an extract refuse piece. This completes the first process whereby an intermediate form 64 that is hollow is produced. The second and third processes which then follow are identical to those mentioned in the third embodiment and hence repeated descriptions thereof are omitted.

In the first process mentioned above, typically the solid rod-like blank 49 is made of carbon steel and is hollowed at a rate of reduction in area of 25%. The depths of the upper and lower axial hollows in the blank are each set at a value that is 5 times or more larger than the inner diameter which is a criterion of stable working in a cold forging. To hollow the blank, its boring regions are heated at a temperature ranging between a room temperature and 700° C. and its outer periphery is bound. The solid plug-like portion 73 of the blank may also be axially sheared and forced out as an extract refuse piece by extracting the upper punch 69 and moving the lower punch 70 up further. Alternatively, after one of the punches is extracted, a servomechanism may move the solid rod-like blank 49 back slowly while each of the punches is quickly advanced to shear the plug-like portion 73 out.

In each of the embodiments described above, the blank 6, 26, 49 is heated in part or as a whole at a room temperature or a temperature ranging between 200 and 700° C. for forming at which an oxide film does not develop. It should be noted in this connection that if the blank is formed at a room temperature (by cold forging), its deformation raises its temperature to 200 to 700° C.

Figure 21:
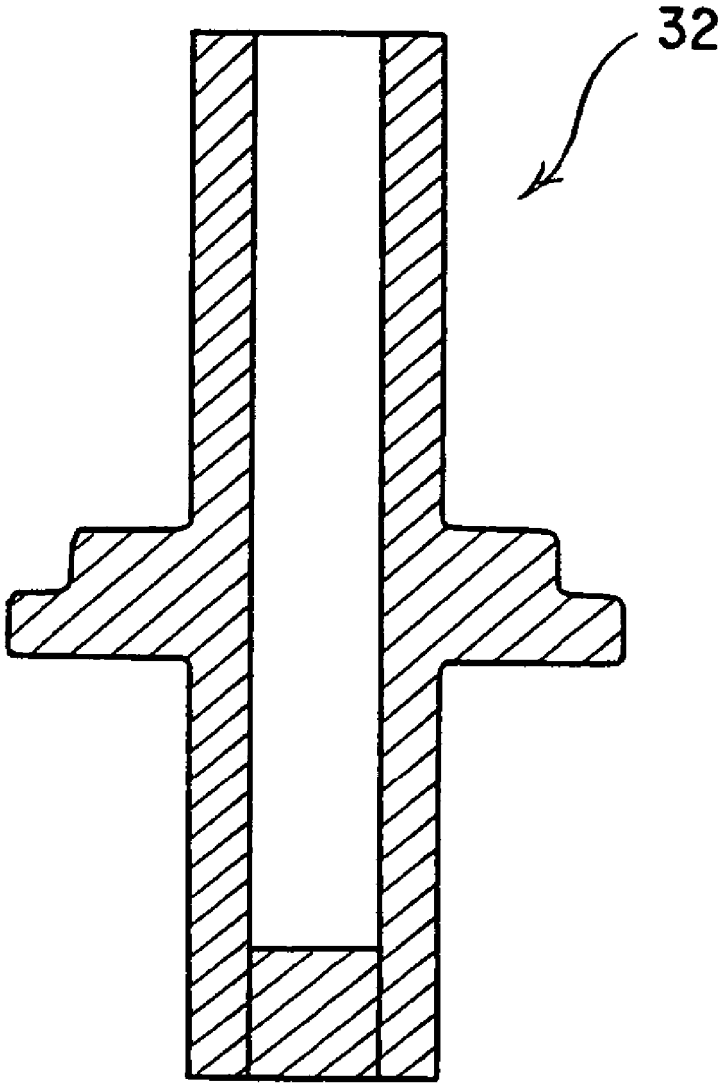
FIG. 21 is a cross sectional view illustrating another hollow stepped shaft that can be formed by each of the embodiments of the present invention mentioned above.
Figure 22A:
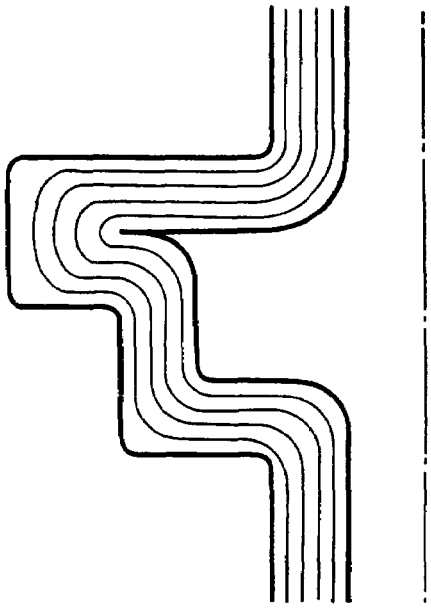
FIGS. 22A and 22B are explanatory views illustrating grain flows in a stepped enlarged radial section according to the conventional forming method.
Figure 22B:
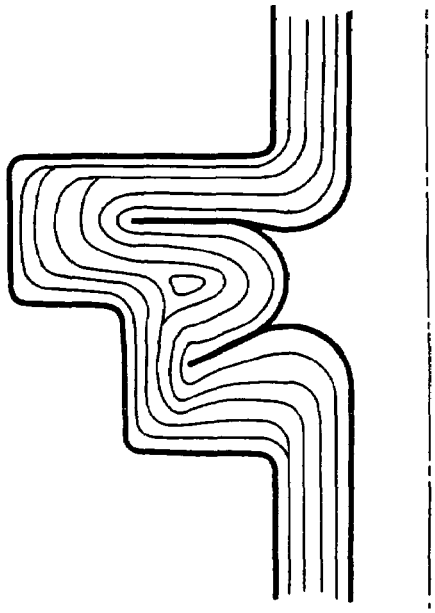
Figure 23:
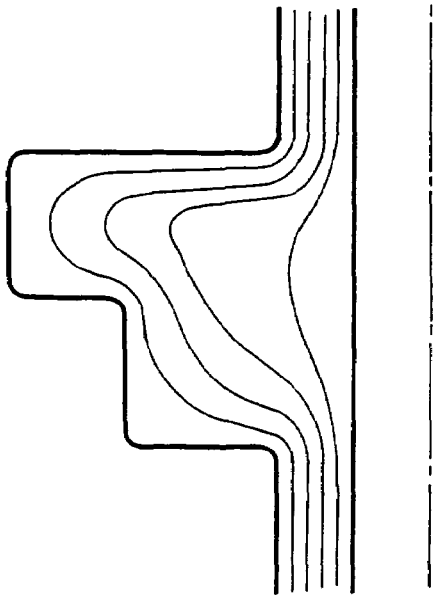
FIG. 23 is an explanatory view illustrating grain flows in such a stepped enlarged radial section according to the method of the present invention.

In the embodiments mentioned above, a hollow stepped shaft with one of its ends closed as shown in FIG. 21 may be obtained by leaving the solid plug-like portion 17, 31, 65, 73 in the shaft rather than forcing it out entirely with the punch 10, 29*a*, 53*a*, 69. Also, a stepped portion of larger diameter may be located at one end of a hollow stepped shaft 1, 20, 40.

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences of scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

We claim:

1. A method of forming a hollow stepped shaft, comprising:

extruding a solid rod blank from opposite axial ends of the blank with a first punch and a second punch while restraining an outer periphery of the blank, so as to form a pair of axial hollows in two axial parts of the blank, respectively, and such that a solid plug portion of the blank remains between the pair of axial hollows;

compressively moving one of the first and second punches to shear the solid plug portion out of the blank so as to form a hollow blank having a single continuous axial hollow formed from the pair of axial hollows; and extruding the hollow blank forwards and backwards with a third punch and a fourth punch so as to form a stepped portion that is enlarged in both diameter and thickness in a region of the blank that is one of: (i) intermediate between the opposite ends of the blank and (ii) at one of the ends of the blank, while simultaneously making the blank longer.

2. The method according to claim 1, wherein the solid plug portion is sheared out of the blank by one of the first and second punches after the other of the first and second punches is extracted from the blank and while the blank is supported resiliently at one of the opposite ends by one of a hydraulic device and a pneumatic device.

3. The method according to claim 1, wherein the solid plug portion is sheared out of the blank by extracting one of the first and second punches and thereafter rapidly advancing the other of the first and second punches while one of the opposite ends of the blank is moved back slowly by a servo mechanism.

4. The method according to claim 1, wherein the solid rod-like blank is made of carbon steel and is hollowed at a rate of reduction in area of 25%;

wherein a depth of each of the axial hollows in the blank is at least 5 times larger than an inner diameter of the axial hollow, which is a criterion of stable working in a cold forging; and wherein boring regions are heated at a temperature ranging between room temperature and 700° C.

5. The method according to claim 2, wherein the solid rod-like blank is made of carbon steel and is hollowed at a rate of reduction in area of 25%;

wherein a depth of each of the axial hollows in the blank is at least 5 times larger than an inner diameter of the axial hollow, which is a criterion of stable working in a cold forging; and wherein boring regions are heated at a temperature ranging between room temperature and 700° C.

6. The method according to claim 3, wherein the solid rod-like blank is made of carbon steel and is hollowed at a rate of reduction in area of 25%;

wherein a depth of the axial hollow in the blank is set at a value that is at least 5 times larger than an inner diameter of the axial hollow, which is a criterion of stable working in a cold forging; and wherein boring regions are heated at a temperature ranging between room temperature and 700° C.

7. The method according to claim 1, wherein the hollow stepped shaft has regions at axial end portions thereof where serrations are formed which have a tooth form applied thereto by one of fitting and press-and-shrink fitting, and said regions are at least one of further drawn and made smaller in diameter by multistage pressure forming with upper punches and lower dies.

8. The method according to claim 2, wherein the hollow stepped shaft has regions at axial end portions thereof where serrations are formed which have a tooth form applied thereto by one of fitting and press-and-shrink fitting, and said regions are at least one of further drawn and made smaller in diameter by multistage pressure forming with upper punches and lower dies.

9. The method according to claim 3, wherein the hollow stepped shaft has regions at axial end portions thereof where serrations are formed which have a tooth form applied thereto by one of fitting and press-and-shrink fitting, and said regions are at least one of further drawn and made smaller in diameter by multistage pressure forming with upper punches and lower dies.

* * * * *